United States Patent [19]

Dupuis

[11] 4,371,168

[45] Feb. 1, 1983

[54] POCKET-SIZE CHESS GAME

[76] Inventor: Robert C. Dupuis, 532 du Roi St., Quebec, Canada, G1K 2X2

[21] Appl. No.: 271,633

[22] Filed: Jun. 8, 1981

[51] Int. Cl.[3] ..... A63F 3/01

[52] U.S. Cl. ..... 273/239; 273/282; 273/285; 206/315 R

[58] Field of Search ..... 273/284, 285, 260, 283, 273/287; 206/315 R

[56] References Cited

U.S. PATENT DOCUMENTS

| | | | |
|---|---|---|---|
| 1,641,104 | 8/1927 | Solod | 273/285 |
| 1,849,676 | 3/1932 | Loewenthal | 273/285 |
| 3,995,704 | 12/1976 | Blickman | 273/285 |

FOREIGN PATENT DOCUMENTS

| | | | |
|---|---|---|---|
| 154406 | 1/1920 | United Kingdom | 273/285 |
| 1436453 | 1/1976 | United Kingdom | 273/285 |

OTHER PUBLICATIONS

U.S. Trademark Reg. No. 1,083,639, Reg. 1/1978.
U.S. Trademark Reg. No. 954,371, Reg. 3/1973.

*Primary Examiner*—Richard J. Apley
*Assistant Examiner*—Carl Moy

[57] ABSTRACT

A pocket-size chess set is disclosed, comprising a pair of identical panels pivotally secured at their inner edges to a narrow third intermediate panel, whereby the first two panels may be folded together to form a case with the third panel acting as a spine. Two slidable para-magnetic checkerboard halves are provided, on the top surface of each of the first two panels. Thirty-two chessmen are also provided. Each of the latter is provided with a magnetic element on its back and bottom surfaces. Thus, each chessman may be placed either horizontally or vertically on the checkerboard halves. The squares of the latter have a recessed portion and their margins are also recessed for the placing of captured chessmen thereon. The case is kept in closed position by the magnetic attraction of the chessmen for one another.

6 Claims, 7 Drawing Figures

Fig. 3
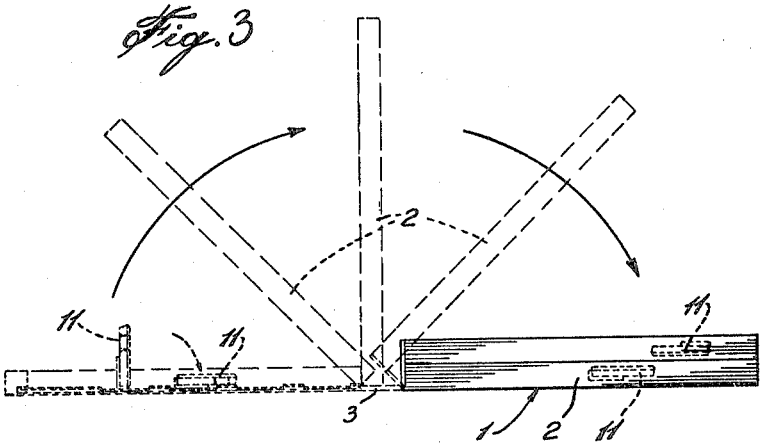
Fig. 4
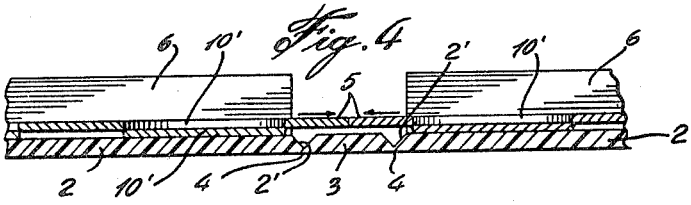
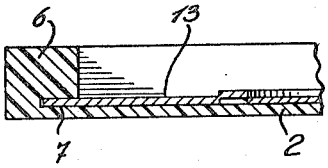
Fig. 5
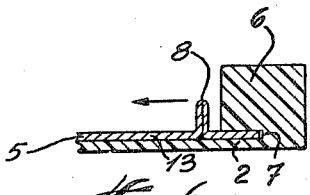
Fig. 6
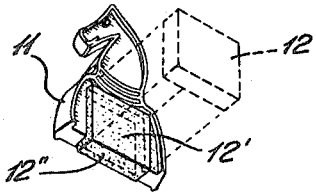
Fig. 7

POCKET-SIZE CHESS GAME

FIELD OF THE INVENTION

The present invention relates to portable games, more specifically to an improved pocket-size chess set.

BACKGROUND OF THE INVENTION

Various types of pocket-size chess sets have been disclosed in the prior art. Among these, one well-known chess set is the one having holes in each space of the checkerboard adapted to receive a peg formed in the chessmen. If there is any vibration of the checkboard, as on a train or airplane, the chessmen set is liable to be jarred loose from its holes and so ruin the game. Another disadvantage of this type of chess set is that, when the game is interrupted, captured chessmen have to be carried in a separate container and may be lost. Still another disadvantage is that the chessmen are very small, because they stay upright on the chessboard when the latter is carried in one's pocket. They are therefore difficult to identify. In another type of pocket-size chess set, the chessmen lay flat on the chessboard and the chessplayer has difficulty to identify the three different values of chessmen, since he is accustomed to do so by the three different heights of the chessmen in a regular chess set.

OBJECTS OF THE INVENTION

Accordingly, it is a first object of the present invention to provide a pocket-size chess set in which the chessboard is foldable in two to form a case and wherein each chessman may be positioned either vertically for play or horizontally for storage; therefore, the chessmen have a sufficient height for easy identification and yet the chessboard has a minimum width when closed for carrying in one's pocket.

It is still another object of the present invention to provide a portable chess set, wherein the chessmen carry permanent magnets to adhere the same to the checkerboard and the latter is formed of two flat panels which fold together by the magnetic attraction of the chessmen.

It is yet another object of the present invention to provide a portable chess set which is simple in design and construction.

SUMMARY OF THE INVENTION

The above and other objects and advantages of the present invention are realized according to a preferred embodiment comprising a generally rectangular carrying case composed of a pair of identical panels and a third intermediate panel. The inner sides of the first two panels are each pivotally secured to either side, respectively, of the third panel, the latter extending between the inner sides of the first two panels. Thus, the first two panels can be folded together with the third panel acting as a spine to make a thin compact carrying case.

The perimeter of each of the first two panels is provided with an inwardly-extending flange defining a perimetrical slot between the bottom surface of the panels and the flange itself.

The slot retains, on each of the first two panels, half of a checkerboard, made of paramagnetic material. Each of these halves is adapted to slide horizontally, from a first retracted position when the first two panels are folded, to a second playing position, wherein their inner sides touch to form an integral checkerboard.

Means are provided to move each checkerboard half between the two positions. Other means are also provided to limit the inward movement of each checkerboard half.

Each square of the checkerboard halves has a recessed portion for a purpose explained below.

The chess set of the invention also includes thirty-two chessmen. Each of these chessmen is relatively thin and is provided with a magnetic element having a back surface and a narrow bottom surface projecting slightly below its lower end. Thus, each chessman may be positioned on the checkerboard either vertically for play, or horizontally for storage. In both positions, the magnetic element is in contact with the recessed portion, so that each piece is properly centered on its square. When a piece is laid horizontally on a square, it lies perfectly flat because the back surface of its magnetic element extends into the recess.

The outer edges of each checkerboard half are also recessed for the placing of captured chessmen thereon during the course of the game. If the game must be interrupted and stored or carried, these chessmen will not be a hindering factor to the closing of the two panels together.

No means are necessary to close the panels together, since the magnetic attraction of the chessmen for one another is enough to assure a closing force.

The above will be more clearly understood by having referral to the preferred embodiment of the invention, illustrated by way of the accompanying drawings, in which:

BRIEF DESCRIPTION OF THE DRAWINGS

FIG. 3 is a lateral elevation of the two panels in closed position, also showing in dashed outline how one of the panels pivots to a closed position;

FIG. 4 is a cross-sectional view taken along line 4—4 of FIG. 2;

FIG. 5 is also a cross-sectional view, taken along line 5—5 of FIG. 1;

FIG. 6 is another cross-sectional view, taken along line 6—6 of FIG. 1; and FIG. 7 is a perspective view of a chessman showing, in dashed outline, an exploded view of the magnetic element.

Like numerals refer to like elements throughout the drawings.

DETAILED DESCRIPTION OF THE INVENTION

Figure 1:
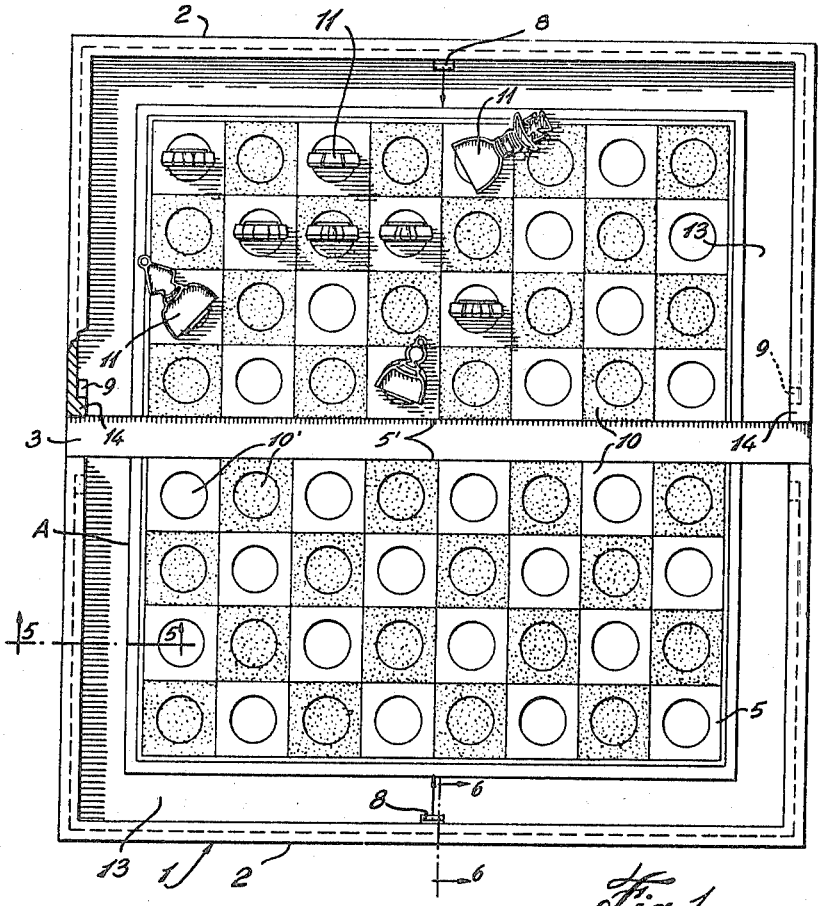
FIG. 1 is a top plan view of the chess set showing the checkerboard halves in retracted positions, also showing several chessmen in both upright and flat position, also showing a portion of the edge of one panel broken away to reveal the checkboard half-stop means.
Figure 2:
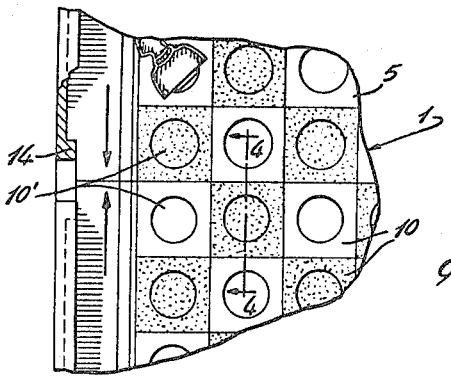
FIG. 2 is an enlarged top plan view of the center-left side of the chess set showing the checkerboard halves in playing position.

The pocket-size chess set 1 of the present invention comprises a pair of identical rectangular panels 2 and a third intermediate panel 3, all of the above being made of rigid plastic or other suitable material.

The inner edge 2' of each panel 2 is hingedly secured to one side of intermediate panel 3 at 4, as clearly shown in FIG. 4. Thus, either panel 2 can be pivoted from a first open flat position to a closed position for storage or carrying purposes, as shown in FIG. 3. In closed position, the panels form a thin, compact case.

The top surface of each panel 2 is provided with a horizontally-slidable checkerboard half 5, made of para-magnetic material, such as steel. To retain the latter in position, the lateral and outer edges of each panel 2 have an inwardly-projecting peripheral flange 6, which defines a slot 7.

As seen clearly in FIGS. 5 and 6, the edges of checkerboard halves 5 are slidingly engaged in slot 7 and can slide from a retracted position (shown in FIG. 1) and an engaged play position (shown in FIG. 4), wherein their inner sides 5' meet over intermediate panel 3 to form a complete checkerboard.

An upwardly-projecting tab 8 is secured to each half 5 adjacent their rear edges to slide the halves 5 from one position to the other.

Means are also provided to properly center the halves 5 together when they form a complete checkerboard, consisting of a notch 9 located on each lateral side edge of each half 5 and adjacent the inner edge of each of the latter. Notch 9 is adapted to engage a protuberance 14 formed on flange 6 adjacently thereof.

As shown clearly in FIG. 1, each half 5 is made with alternating light and dark squares 10 in quincunx. Squares 10 each have a central circular recess 10'.

A set of thirty-two chessmen 11 is also an integral part of the invention. It is to be noted that one particular disadvantage of prior art pocket-size chess games is that the chessmen themselves are difficult to identify, because of small size and amorphous detail. To rectify this disadvantage, chessmen 11 of the present invention are relatively tall and provided with detail. For example, the kings and queens are approximately one inch tall. Each chessman 11 is made of molded plastic and is provided with a small magnetic element, namely: a permanent magnet 12, having a back surface 12' and a narrower bottom surface 12'', both surfaces being positive.

It will be clear that chessmen 11 may be placed either uprightly or flat on squares 10. When laid flat, back surface 12' directly adheres to checkerboard half 5. In both positions, magnetic elements 12 will hold the chessmen 11 in place. Thus, a game may be played to a certain point and then interrupted by merely laying chessmen 11 flat to close the panels 2 without moving any chessman 11 from its position on the checkerboard. The depth of recess 10' in each square 10 is approximately equal to the distance, so that the back surface 12' protrudes from the back of each chessman 11.

When the panels 2 are closed, the attraction between magnetic elements 12 and the superposed checkerboard halves 5, provides enough force to keep panels 2 in closed position. When the panels are closed the air gap and the intervening layer of chessman plastic material between the two permanent magnets 12 of opposite chessman, are sufficient to prevent magnetic attraction of said two pieces, so that each piece remains attracted to its checkerboard half 5 when the panels are reopened.

There is one additional feature to the invention: each checkerboard half 5 is provided with a lateral and outer side peripheral margin 13. This margin 13 is recessed to the same depth as recesses 10' in the checkerboard squares 10. Captured chessmen 11 may be conveniently laid flat in margins 13 without stopping the game if the chess set must be closed and without interfering with the closing of the panels 2.

What I claim is:

1. A pocket-size chess set comprising a pair of identical flat and generally rectangular panels; a third narrow, intermediate panel, each of the said pair of panels having an inner edge pivotally secured to one side of said third panel, the latter extending between said inner edges of said pair of panels; each of said pair of panels having a top surface, said top surface being provided with half a slidable checkerboard; each said half being made of a para-magnetic material and slidable from a first retracted position and a second play position, wherein their inner sides touch over said third panel, forming a complete checkerboard; means to slidably retain each said half on each said top surface; means to limit the inward movement of each said checkerboard half when the latter are in play position; further comprising a set of thirty-two chessmen; each said chessman having a back surface provided with a small permanent magnet which projects slightly below the bottom of each said chessman, whereby said chessmen may be placed either vertically or horizontally on said checkerboard halves, each of the latter having a lateral and outer side margin for the placing of captured chessmen thereon during the course of a game.

2. A pocket-size chess set as claimed in claim 1, wherein said means to slidably retain each said half consists of an inwardly-projecting flange provided all along the lateral and outer periphery of each said pair of panels; said flange defining a peripheral slot and said halves being slidingly engaged in said slot.

3. A pocket-size chess set as claimed in claim 2, wherein said means to limit the inward movement of each said checkerboard half consists of a notch located on each lateral edge of each half and adjacent the inner edge thereof; and a protuberance formed on said flange adjacently thereof, said notch engaging said protuberance when said halves are slid into play position.

4. A pocket-size chess set as claimed in claim 1, wherein each checkerboard half is provided with an upwardly-projecting tab secured adjacent its outer edge, whereby each said half may be slid into either said position.

5. A pocket-size chess set as claimed in claim 1, wherein each said checkerboard half has a plurality of squares for chess and each of these squares is provided with a central recessed portion.

6. A pocket-size chess set as claimed in claim 5, wherein said margin of each said checkerboard half is also recessed.

* * * * *